United States Patent [19]

Henriksson

[11] Patent Number: 4,532,398

[45] Date of Patent: Jul. 30, 1985

[54] INDUCTION COIL

[75] Inventor: Bengt Henriksson, Helsingborg, Sweden

[73] Assignee: ASEA Aktiebolag, Västerås, Sweden

[21] Appl. No.: 446,050

[22] Filed: Dec. 1, 1982

[30] Foreign Application Priority Data

Dec. 4, 1981 [SE] Sweden ..... 8107289

[51] Int. Cl.[3] ..... H05B 6/36

[52] U.S. Cl. ..... 219/10.79; 219/10.49 R; 219/10.67; 336/96; 373/161

[58] Field of Search ..... 219/10.79, 10.49 R, 219/10.67; 373/152, 155, 156, 160, 161, 162, 163, 164; 432/264, 265, 248; 336/96, 90; 165/136

[56] References Cited

U.S. PATENT DOCUMENTS

| | | | |
|---|---|---|---|
| 2,435,866 | 2/1948 | Bilhuber | 219/10.81 X |
| 3,303,258 | 2/1967 | Junker | 373/156 X |
| 3,378,917 | 4/1968 | Lapham | 219/10.79 X |
| 3,539,768 | 11/1970 | Eisler | 219/213 |
| 3,735,011 | 5/1973 | Soykan | 373/164 |
| 4,045,183 | 8/1977 | Barowski et al. | 269/237 X |
| 4,142,063 | 2/1979 | Boniort et al. | 219/10.49 R X |
| 4,245,207 | 1/1981 | Murakami et al. | 336/96 X |
| 4,429,698 | 2/1984 | Bentall | 128/422 |

FOREIGN PATENT DOCUMENTS

| | | |
|---|---|---|
| 1095420 | 12/1960 | Fed. Rep. of Germany . |
| 2070038 | 10/1971 | France . |
| 797084 | 1/1981 | U.S.S.R. . |

OTHER PUBLICATIONS

Preventative Disclosure No. 13/60 (Industrial Teknik 10, 1960).

*Primary Examiner*—Philip H. Leung
*Attorney, Agent, or Firm*—Watson, Cole, Grindle & Watson

[57] ABSTRACT

An induction coil, preferably for an induction heater, comprises a working coil, an outer casing and an inner lead-through channel for the workpieces, such as rods or tubes, which are to be treated in the induction coil. The region of the outer casing closest to the working coil consists of a layer of a rubber-elastic compound outside which is arranged a concrete casing. Using a two-part outer casing of this kind avoids the use of asbestos which is increasingly suspect because of its health hazard.

17 Claims, 4 Drawing Figures

FIG. 1
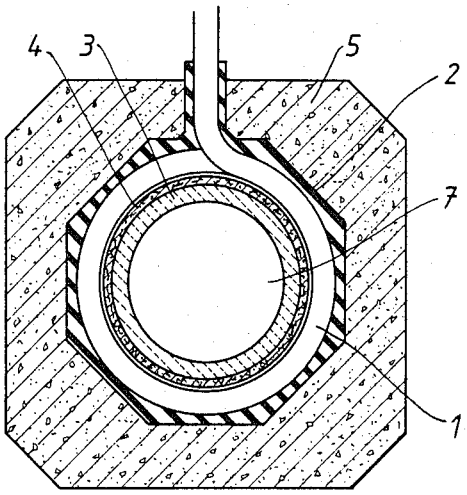
FIG. 2
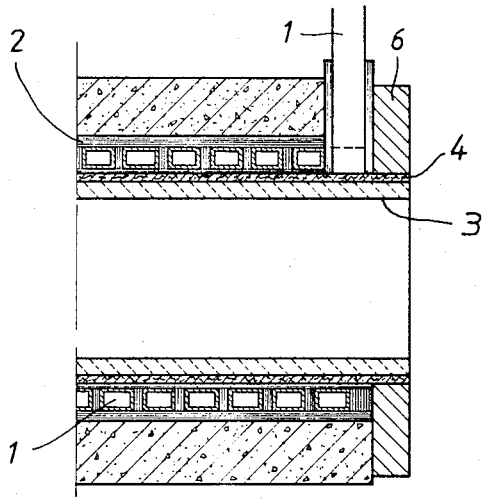
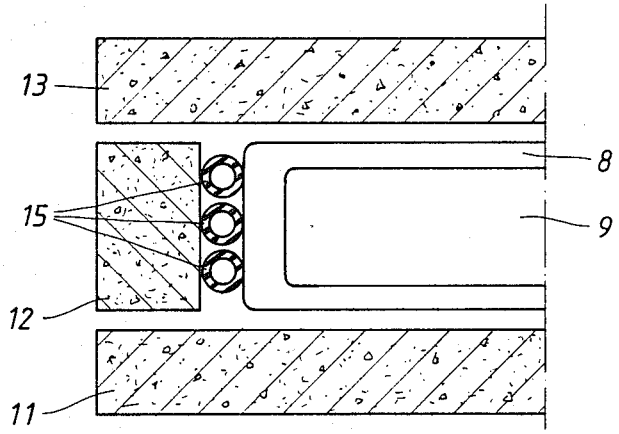
FIG. 4

INDUCTION COIL

TECHNICAL FIELD

The present invention relates to an induction coil, preferably for an induction heater, comprising a working coil of electrically conducting material, an outer casing surrounding the working coil and an inner lead-through channel within the working coil for workpieces, such as rods or tubes, which are to be treated (e.g. heated) in the induction coil.

DISCUSSION OF PRIOR ART

It is known to surround the working coils of many types of induction heaters with a layer of an asbestos-containing material for heat insulation and electrical insulation of the working coil. The use of asbestos is disadvantageous because of the health risks associated therewith and the obtaining of a staisfactory asbestos-free replacement material for the outer casing of an induction coil poses problems.

BRIEF STATEMENTS OF INVENTION

The invention seeks to provide a solution to the above-mentioned problem and other problems associated therewith.

According to one aspect of the invention there is provided an induction coil comprising an electrically conducting working coil, an outer casing for the coil and a lead-through channel disposed within the working coil for workpieces which are to be treated therein, the outer casing comprising a layer of rubber-elastic material adjacent to the working coil and a mass of concrete surrounding said layer.

According to a further aspect of the invention an induction coil comprising a helix of electrically conducting tubular material, a refractory electrically insulating tube disposed within the helix to define a through-channel for elements to be treated within the coil and an electrically insulating casing surrounding the helix, is characterised in that the casing is in two parts, an inner part of silicone rubber surrounding the helix, and an outer part of a refractory asbestos-free set hydraulic cementitious mixture surrounding the inner part.

The invention allows the production of an induction coil which does not require the use of asbestos materials and yet provides a refractory, mechanically strong outer casing for the working coil. The rubber-elastic material absorbs vibrations and distributes the electromagnetic forces generated by the working coil and the mechanical forces arising because of the thermal expansion of the working coil during use. Good noise-damping properties and very good electrical insulating properties are obtained. In addition, the inner layer of rubber-elastic material prevents bursting of the surrounding concrete mass.

BRIEF DESCRIPTION OF DRAWINGS

The invention will be exemplified in greater detail, by way of example, with reference to the accompanying drawings, in which:

FIG. 1 shows one embodiment of induction coil in a transverse cross-section,

FIG. 2 shows a longitudinal cross-section of one end of the induction coil of FIG. 1, FIG. 4 shows an alternative arrangement for the resilient layer along the short sides of a working coil.

DESCRIPTION OF PREFERRED EMBODIMENTS

Figure 3:
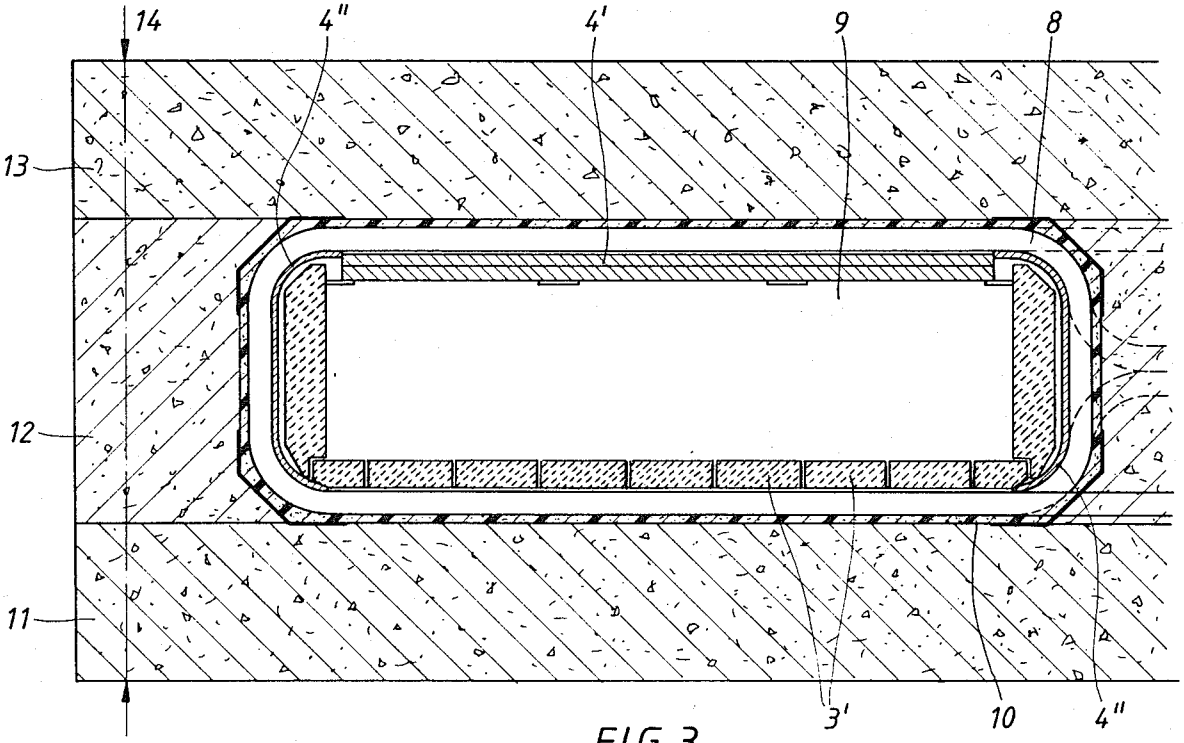
FIG. 3 shows an alternative embodiment of induction coil according to the invention also in transverse cross-section.

FIG. 1 shows a hollow metallic helical induction coil 1 embedded in a two-part casing, the inner part 2 of which is formed from a rubber-elastic compound, suitably a temperature-resistant silicone rubber, which can withstand a temperature of about 200° C. The inner casing part 2, since it is made of a castable material, can be applied in a fluid condition around the working coil 1 and allowed to harden in situ. Surrounding the flexible casing part 2, an outer casing part 5 of concrete is provided, suitably refractory concrete, which is preferably glass fiber reinforced. The outer part 5 provides the necessary mechanically strong support for the working coil, and the complete casing 2, 5 also provides a good thermal shield and good electrical insulation for the working coil. The rubber-elastic layer 2 damps out and distributes the electromagnetic forces, which are generated by the working coil 1, and absorbs the forces arising because of changes in dimensions of the working coil due to its thermal expansion. In addition, the flexible inner layer 2 has good noise- and vibration-damping properties. Silicone rubber is particularly suitable since it has very good electrical insulation properties. Without the layer 2 of rubber-elastic material there would be a risk of the forces generated by the coil 1, during use, bursting the more rigid outer refractory concrete layer 5.

Inside the working coil 1 a ceramic lining 3 is provided. The lining 3 can, for example, be a prefabricated ceramic tube, and between the coil 1 and the lining 3 there is a felt layer 4, the main task of which is to serve as a heat-insulating layer reducing the rate of heat transfer from the lining 3 to the working coil 1. The ceramic lining 3 defines the outer extremity of a lead-through channel 7 through which workpieces, such as rods and tubes, which are to be heated by the working coil 1, can be passed through the coil.

The felt layer 4 also acts as a resilient layer, helping to absorb and damp the movements of the coil 1 permitted by the surrounding flexible layer 3.

FIG. 2 shows a longitudinal section through the coil of FIG. 1 and in particular shows one end of the coil, the end walls 6 of which are made of a refractory material and are constructed as replaceable units that can be bricked or glued to the outer part 5. The working coil 1, which is seen in longitudinal cross-section in FIG. 2, being hollow, can be traversed by flows of a cooling liquid, such as water.

One of the tasks of the ceramic tube 3 is to act as a radiation shield for the felt layer 4, the working coil 1, and the parts 2 and 5 of the outer casing. The coil would typically be supplied with single-phase a.c. current at a frequency lying between 50 and 10,000 Hz.

FIG. 3 shows a transverse section through a second embodiment of an induction coil with a lead-through channel 9, the working coil 8 and the channel 9 both having substantially rectangular cross-sections. The coil 8 is surrounded by a layer 10 of a rubber-elastic compound, which, in turn, is located in an array of prefabricated concrete blocks 11, 12, 13, joined together in any suitable way, for example by means of screw-threaded clamping means acting in the direction of the arrows 14. The rubber-elastic compound making up the layer 10 fills up the space between the coil 8 and the inner surface of the blocks 11, 12, 13. The channel 9 is lined around the bottom and sides with refractory ceramic slabs 3' and along the top with a thick layer 4' of suitable thermally insulating fibrous sheeting. Thinner layers of insulating sheeting 4'' extend down the sides of the channel 9 between the side slabs 3' and the working coil 8.

Instead of, or in addition to, a substantially continuous rubber-elastic layer, compressible bodies 15 can be inserted along the short sides of the coil 8 in the manner shown in FIG. 4. These compressible bodies 15, which are suitably of rubber, may be air-filled since this allows the compressive effect of the bodies 15 to be controlled from the outside, for example by varying the air pressure in one or more of the bodies 15.

The concrete mass can be a concrete as used in the construction industry or a refractory concrete. The resilient layer surrounding the working coil can be a silicone rubber capable of withstanding a temperature of 250° C. An air-hardening material applied in fluid state is preferred.

Natural rubber or other rubber-like synthetic resin materials can also be used.

The arrangements described with reference to the drawings may be varied in many ways within the scope of the following claims.

What is claimed is:

1. An induction coil comprising an electrically conducting working coil, an outer casing for the coil and a lead-through channel disposed within the working coil for workpieces which are to be treated therein, the outer casing comprising at least one compressible hollow body of a temperature-resistant silicone rubber, capable of withstanding temperature of about 200 degrees C., adjacent to the working coil and a mass of concrete over said hollow body.

2. An induction coil according to claim 1, in which a silicone rubber layer is cast around the working coil.

3. An induction coil according to claim 2, in which the working coil is of substantially rectangular cross-section and a layer of silicone rubber is between the working coil and the mass of concrete.

4. An induction coil as claimed in claim 3, in which a plurality of hollow bodies are located along the shorter side of the cross-section of the working coil.

5. An induction coil as claimed in claim 4, in which means is provided to pressurize the interior of each hollow body.

6. An induction coil according to claim 1, in which the concrete is a refractory concrete.

7. An induction coil according to claim 6, in which the concrete is reinforced with glass fibers.

8. An induction coil according to claim 1, in which a ceramic lining defines the lead-through channel within the working coil.

9. An induction coil according to claim 8, in which a layer of felt is arranged between the ceramic lining and the working coil.

10. An induction coil according to claim 1, in which an axial end of the induction coil is defined by an end wall of refractory material.

11. An induction coil as claimed in claim 10, in which the end wall is replaceable.

12. An induction coil according to claim 1, in which the mass of concrete is formed from a plurality of prefabricated blocks secured together.

13. An induction coil according to claim 12, in which the working coil and the lead-through channel are each of substantially rectangular cross-section.

14. An induction coil comprising a helix of electrically conducting tubular material, a refractory electrically insulating tube disposed within the helix to define a through-channel for elements to be treated within the coil and an electrically insulating casing surrounding the helix, the casing being in two parts, an inner part of at least one compressible hollow body of temperature resistant silicone rubber, capable of withstanding temperature of about 200 degrees C., about the helix, and an outer part of a refractory asbestos-free set hydraulic cementitious mixture over the inner part.

15. A coil as claimed in claim 14, in which the inner part includes a layer formed by casting a hardenable fluid silicone around the helix.

16. A coil as claimed in claim 15, in which the outer part is reinforced with glass fibers.

17. A coil as claimed in claim 14, in which the outer part of the casing comprises prefabricated blocks clamped together around the inner part of the casing and the helix, and the interior of the helix is lined with an electrically insulating refractory sleeve.

* * * * *